US008128190B2

(12) United States Patent
Nishimura et al.

(10) Patent No.: US 8,128,190 B2
(45) Date of Patent: Mar. 6, 2012

(54) INK CIRCULATION TYPE INKJET PRINTER

(75) Inventors: Asayo Nishimura, Ibaraki-ken (JP); Yoshiyuki Okada, Ibaraki-ken (JP)

(73) Assignee: National University Corporation Hokkaido University, Hokkaido (JP)

( * ) Notice: Subject to any disclaimer, the term of this patent is extended or adjusted under 35 U.S.C. 154(b) by 445 days.

(21) Appl. No.: 12/458,435

(22) Filed: Jul. 13, 2009

(65) Prior Publication Data

US 2010/0013883 A1 Jan. 21, 2010

(30) Foreign Application Priority Data

Jul. 15, 2008 (JP) ..... P2008-184159

(51) Int. Cl.
*B41J 2/165* (2006.01)
*B41J 29/38* (2006.01)
*B41J 2/18* (2006.01)

(52) U.S. Cl. ..... 347/22; 347/14; 347/89

(58) Field of Classification Search ..... 347/14, 347/22, 89

See application file for complete search history.

(56) References Cited

U.S. PATENT DOCUMENTS 6,398,336 B1 * 6/2002 Yoda et al. ..... 347/23
7,240,983 B2 * 7/2007 Kojima ..... 347/23

FOREIGN PATENT DOCUMENTS

JP 11-192729 7/1999
JP 2002-086754 3/2002

* cited by examiner

*Primary Examiner* — Geoffrey Mruk
(74) *Attorney, Agent, or Firm* — The Nath Law Group; Tanya E. Harkins; Mihsuhn Koh

(57) ABSTRACT

An ink circulation type inkjet printer includes a maintenance controller configured to: (1) allow a maintenance mechanism to execute maintenance processing for a plurality of inkjet heads before a present printing job under three conditions that: (c1) an elapsed time from a last printing job to a present printing job is less than a first reference time; (c2) the present printing job requests for ejecting ink from unused nozzles of multiple nozzles of the plurality of inkjet heads in the last printing job; (c3) the elapsed time is more than a second reference time; (2) allow the ink circulation type inkjet printer to perform the present printing job without the maintenance processing for the plurality of inkjet heads when the elapsed time is less than the predetermined second reference time.

8 Claims, 9 Drawing Sheets

INK CIRCULATION TYPE INKJET PRINTER

BACKGROUND OF THE INVENTION

1. Field of the Invention

The present invention relates to a maintenance control of an ink head unit in an ink circulation type inkjet printer.

2. Description of the Related Art

An inkjet printer is a printer that prints on sheets by ejecting ink from multiple nozzles provided on inkjet heads. If inkjet printer has not ejected ink for a long time, solvent is evaporated from the ink adhered mainly to the inkjet heads, and the viscosity of the adhered ink is increased. Then the printer is not able to show its true printing performance. Therefore, for the inkjet heads, maintenance is done in some methods such as ink suction and nozzle cleaning before printing when the printing is performed after a predetermined elapsed time from the last performance.

In general, all nozzles of inkjet heads are not necessarily used in each printing. For instance, FIG. 1A shows a color inkjet printer accepting A3 size sheets provided with an ink head unit 230 that includes line type inkjet heads 130K, 130C, 130M and 130Y for black ink, cyan ink, magenta ink and yellow ink, respectively. When the inkjet printer performs printing on an A4 size sheet in color, ink is not ejected from nozzles of areas "a1" and "a2" at both end portions of each inkjet head. Each of the inkjet heads 130K, 130C, 130M and 130Y has alternately-arranged six nozzle plates, each of which is provided with multiple nozzles. In other words, the six nozzle plates are arranged on each inkjet head in a zigzag matter.

In such a case, if a printing job requests for printing on an A3 size sheet in color, then the printer is not able to show its true printing performance even if the printing job is performed within a predetermined elapsed time from the last printing job. This is because the time that ink has not been ejected from the nozzles of the areas "a1" and "a2" is longer than the predetermined elapsed time, where these nozzles were not used in the last printing. Therefore, it is preferable that maintenance for the ink head unit 230 is done in view of such a situation.

In addition, as shown in FIG. 1B, when the above-mentioned inkjet printer performs printing on an A4 size sheet in black-and-white, ink is not ejected from the nozzles of whole area of the inkjet heads 130C, 130M and 130Y, and the nozzles at both end portions of the inkjet head 130K In FIG. 1B, the above-mentioned areas of the color inkjet heads and black inkjet head are collectively referred to as an area "a3" as a whole.

In such a case, if a printing job requests for printing on an A4 size sheet in color, then the printer is not able to show its true printing performance even if the printing job is performed within a predetermined elapsed time from the last printing job. This is because the time that ink has not been ejected from the nozzles of the area "a3" is longer than the predetermined elapsed time, where these nozzles were not used in the last printing. Therefore, it is preferable that maintenance for the ink head unit 230 is done in view of such a situation.

To address such issues, Japanese Patent Laid-Open Publication No. H11-192729 discloses a method to determine whether the size of a sheet to be printed in a printing job is the same as that in the last printing job, and to do maintenance for an ink head unit when the sheet size in the printing job is different from that in the last printing job. In addition, Japanese Patent Laid-Open Publication No. 2002-86754 discloses a method to do maintenance for an ink head unit when a printing job requests for printing in color while the last printing job requested for printing in black-and-white.

According to these technologies, maintenances is always done in some methods such as ink suction and nozzle cleaning even if a printing job is performed within a predetermined elapsed time from the last printing job when the present printing job requests for ejecting ink from unused nozzles of inkjet heads in the last printing job. However, these maintenance methods consume ink and require a substantial time to start printing. Therefore, it is preferable that excessive maintenance of the ink head unit is avoided.

SUMMARY OF THE INVENTION

By the way, there have been recently developed inkjet printers possible to execute ink circulation processing in ink circulation routes provided in a casing in order to promote printing performance. Such an ink circulation type inkjet printer can quickly recover difficulty in ejecting ink from nozzles due to the entry of bubbles or dust into the ink. Moreover, ink with an increased viscosity adhered in inkjet heads can be carried along the ink circulation routes because ink is passed through inkjet heads by ink circulation processing.

In general, the ink circulation processing is executed for all the inkjet heads when printing. It is expected here that the ink adhered in an unused inkjet head in printing will have a decreased viscosity because ink circulation processing is also executed for the inkjet head. Thus, when a printing job requests for ejecting ink from the nozzles of an unused inkjet head in the last printing, maintenance processing may not be necessarily executed for the unused inkjet head.

The present invention therefore has an object of providing an ink circulation type inkjet printer not to perform excessive maintenance for an ink head unit.

To achieve the above-described object, an aspect of the present invention provides an ink circulation type inkjet printer, comprising: a plurality of inkjet heads, each of which provided with multiple nozzles to eject ink; a plurality of ink circulation routes, which include the plurality of inkjet heads, respectively; a maintenance mechanism that executes maintenance processing for the plurality of inkjet heads; an ink circulation controller configured to circulate ink in all of the plurality of ink circulation routes for each printing job; and a maintenance controller configured to: (1) allow the maintenance mechanism to execute the maintenance processing for the plurality of inkjet heads before a present printing job under three conditions that: (c1) an elapsed time from a last printing job to the present printing job is less than a first reference time; (c2) the present printing job requests for ejecting ink from unused nozzles of the multiple nozzles in the last printing job; (c3) the elapsed time is more than a second reference time; (2) allow the ink circulation type inkjet printer to perform the present printing job without the maintenance processing for the plurality of inkjet heads when the elapsed time is less than the predetermined second reference time.

DETAILED DESCRIPTION OF THE PREFERRED EMBODIMENT

We will describe below an embodiment of the present invention with reference to FIGS. 2 to 9.

Figure 1A:
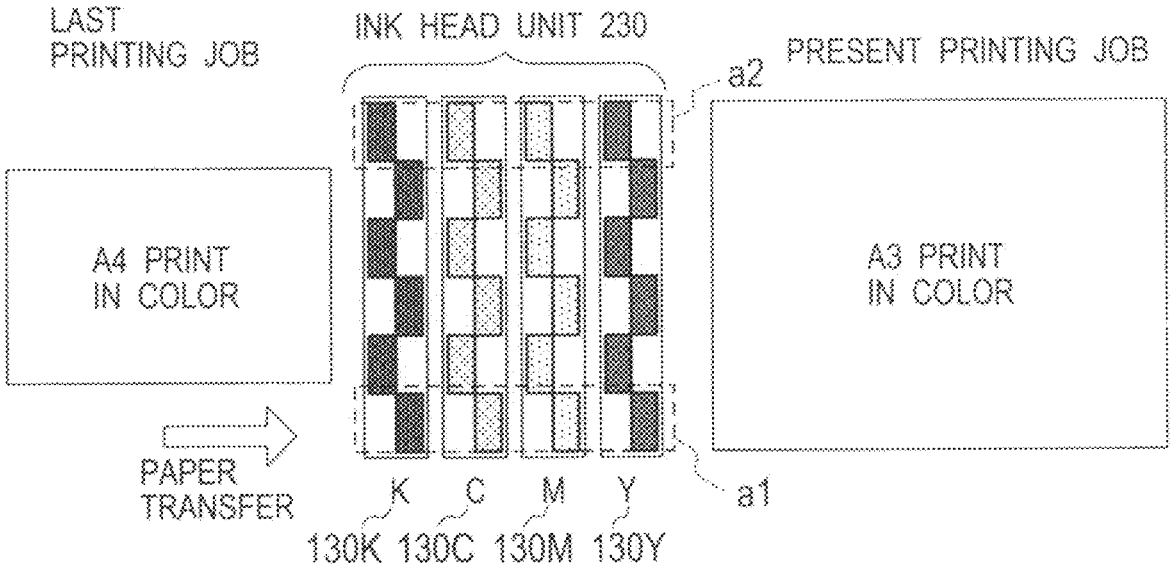
FIGS. 1A and 1B are views showing typical examples of printing that not all inkjet heads are used.
Figure 1B:
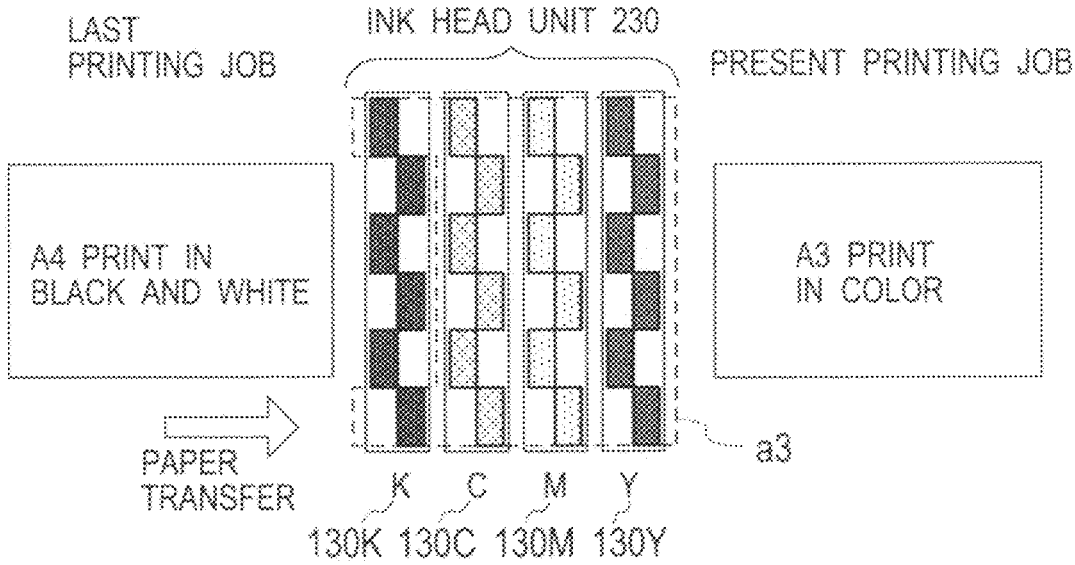
Figure 2:
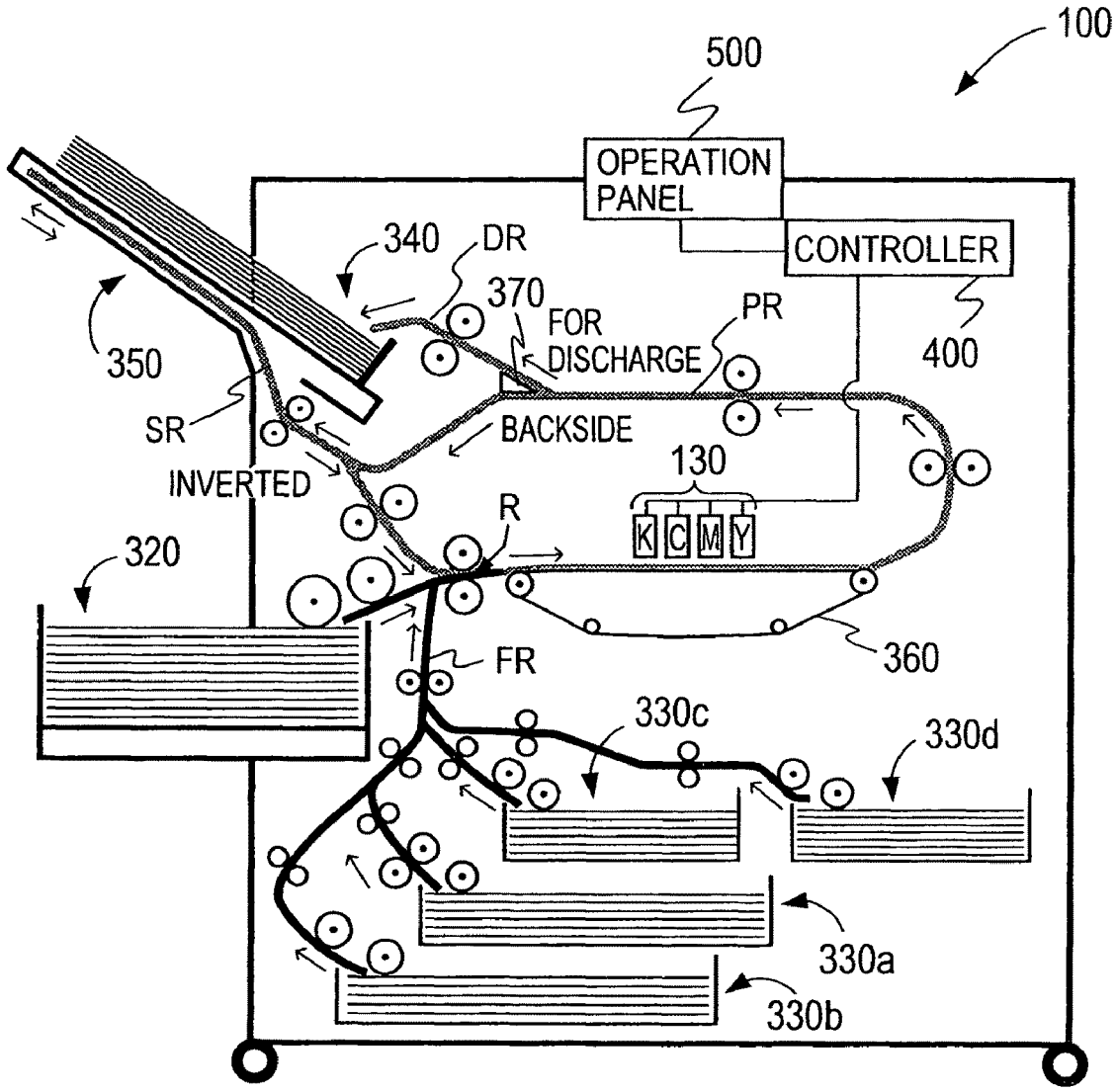
FIG. 2 is a schematic view showing an inkjet printer according to an embodiment of the present invention.

FIG. 2 is a schematic view showing an inkjet printer 100 according to an embodiment of the present invention. The inkjet printer 100 includes a side paper feeding table 320 projecting from a side surface of a casing, and a plurality of paper feeding trays 330*a*, 330*b*, 330*c* and 330*d* provided in the casing as a paper feeder to feed papers to be printed. The inkjet printer 100 also includes a discharging port 340 as a paper discharger to discharge printed papers.

In addition, a paper transfer route in the present embodiment is composed of a system of feed routes FR for feeding sheets, a sheet discharge route DR for discharging the sheets, a normal transfer route PR for transferring the sheets received from the system of feed routes FR to the sheet discharge route DR, and an inverting route (switchback route) SR branched from the normal transfer route PR for inverting the sheets received from the normal transfer route PR, between front side and back side, and for returning the sheets to the normal transfer route PR The inversion route SR cooperates with the normal transfer route PR to constitute a looped sheet circulation transfer route CR.

The inkjet printer 100 is a line color printer of an inkjet type, and has an ink head unit 230 including line type inkjet heads 130K, 130C, 130M and 130Y provided with multiple nozzles in a direction perpendicular to a sheet transfer direction. The inkjet heads 130K, 130C, 130M and 130Y propel droplets of black ink (K), cyan ink (C), magenta ink (M) and yellow ink (Y) from the multiple nozzles, respectively, so as to print on sheets by lines. The inkjet unit 230 of the present embodiment includes four inkjet heads, however, the present invention can employ an ink head unit including "n" inkjet heads where "n" is a natural number.

A sheet fed one by one from a sheet feeding mechanism, which is the side paper feeding table 320 or the paper feeding trays 330, are transferred along one route of the system of feed routes FR by drive mechanisms such as rollers, to a resister R. The resister R includes a pair of resist rollers for positioning a front edge of the sheet to a transfer belt 360 to avoid given an oblique position to the sheet to be carried by the transfer belt 360. A fed sheet enters the resister R, where it is once put in a pause, before being carried to a printing mechanism at predetermined timing.

In the present embodiment, the four inkjet heads 130K, 130C, 130M and 130Y, which constitutes the ink head unit 230 as the printing mechanism, are aligned in this order along a paper transfer direction from the resister R. On the top side of the transfer belt 360, the sheet transferred from the resister R is vacuum-contacted at the back side to be carried at a transfer speed depending on a set of given printing conditions, while on the front side of the sheet an image is formed (printed) by ink propelled from the nozzles of each inkjet head by lines.

The printed sheet is further transferred in the casing by drive mechanisms such as rollers. When one side printing, the printed sheet is direly guided to the sheet discharge port 340, where it is discharged to stack with a printed side down, on a discharge rack 350 provided as a sheet receiver at the sheet discharge port 340. The output tray 350 is set in the form of a tray protruding from the housing, with a certain thickness. The discharge rack 350 is inclined to a lateral wall of the housing, so the printed sheet once discharged from the sheet discharge port 340 is slid down along an inclination of the discharge rack 350, and trimmed to pile up on the discharge rack 350 in due course.

When both side printing, assuming "a front side" thereof as the side to be printed first and "back side" thereof as the side to be printed next a sheet printed on the front side is to be routed inside the casing without being guided to the sheet discharge port 340. This is implemented in the inkjet printer 100 by a route selection mechanism 370 provided to select a sheet transfer route for back side printing. With this route selected by the sheet selection mechanism 370, the sheet printed on the front side is transferred to the inverting route DR. On the inverting route SR, the sheet is switched back in a dropping manner for inversion between front side and back side, and contacts at the (printed) front side with an upside of the sheet transfer route. The sheet is transferred along the inverting route SR by drive mechanisms such as rollers, to re-feed to the register R, where it is put in a pause, before being carried downstream the printing mechanism at a predetermined timing, to have an image formed on the back side in a similar manner to the front side. The sheet, now image-formed on both sides with the back side printed, is guided to the sheet discharge port 340, where it is discharged to stack on the discharged rack 350.

In the inkjet printer 100, an internal space of the discharge rack 350 is availed to implement a dropping switch back for both side printing. The space in the discharged rack 350 is enclosed to keep sheets from being taken from outside in the course of switchback. This prevents the sheets from being pulled out by a mistake of user in the course of switchback. The discharge rack 350, as an inherent member to the inkjet printer 100, affords to eliminate provision of an external space for switchback in the casing of the inkjet printer 100. This permits the casing to be kept from being enlarged in size. The inverting route SR, separated from the sheet discharge port 340, allows for parallel operations between a sheet to be switched back and another sheet to be discharged.

Figure 3:
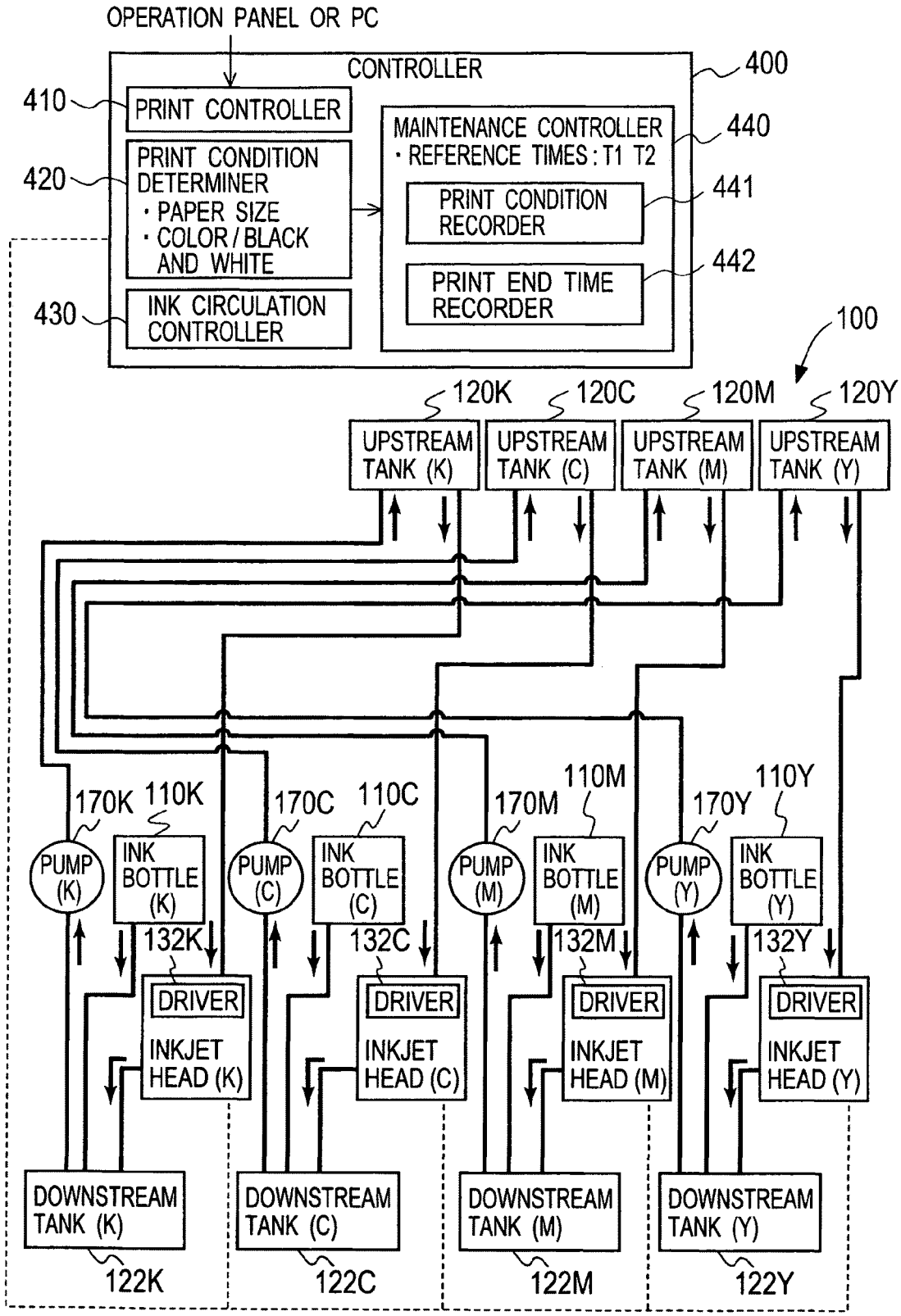
FIG. 3 is a block diagram showing a constitution of ink circulation routes and a controller.

FIG. 3 is a block diagram showing a constitution of ink circulation routes and a controller of the inkjet printer 100. The inkjet printer 100 is detachably provided with an ink bottle 110K supplying black ink, an ink bottle 110C supplying cyan ink, an ink bottle 110M supplying magenta ink and an ink bottle 110Y supplying yellow ink. Note that, when it is not necessary to focus on a specific color below, any one of the ink bottles is simply referred to as a ink bottle 110 and also any one of inkjet heads is simply refereed to as a inkjet head 130.

Ink supplied from the ink bottle 110 is temporally stored in a downstream tank provided downstream of the inkjet head 130, passing through an ink route formed of pipes made of resin, metal, and the like. Thus, the inkjet printer 100 is provided with a downstream tank 122K storing black ink a downstream tank 122C storing cyan ink a downstream tank 122M storing magenta ink and a downstream tank 122Y storing yellow ink. Note that, when it is not necessary to focus on a specific color, any one of the downstream tanks is simply referred to as a downstream tank 122.

The ink stored in the downstream tank 122 is transferred to an upstream tank provided upstream of the inkjet head 130 by means of a pump 170. Thus, the inkjet printer 100 is provided with a pump 170C, a pump 170M, a pump 170Y and a pump 170K, and provided with an upstream tank 120C, an upstream tank 120M, an upstream tank 120Y and an upstream tank 120K. Note that, when it is not necessary to focus on a specific color, any one of the pumps is simply refereed to as a pump 170 and also any one of the upstream tanks is simply referred to as an upstream tank 120.

Ink transferred to the upstream tank 120 is further transferred to the inkjet head 130 and then ejected from the multiple nozzles provided in the inkjet head 130 to be used for printing.

In the present embodiment, the inkjet head 130 is an inkjet head to eject ink by use of a piezo element However, in the present invention, we can adopt an inkjet head that ejects ink by use of a heater element for heating ink and forming bubbles.

The inkjet heads 130K, 130C, 130M and 130Y are provided with drivers 132K, 132C, 132M and 132Y to drive the piezo elements based on image data sent from a controller 400, respectively. Note that, when it is not necessary to focus on a specific color, any one of the drivers is simply referred to as a driver 132.

As described above, the inkjet printer 100 of the present embodiment employs a system of ink circulation routes so that the ink in the inkjet head 130 not consumed in printing is returned to the downstream tanks 122. Ink circulation processing in an ink circulation route, which is a looped route starting from the upstream tank 120 and returning itself via the inkjet head 130 and the downstream tank 122, is operated by use of water head difference between the upstream tank 120 and the downstream tank 122. Such ink circulation processing can quickly recover difficulty in ejecting ink from the nozzles of the inkjet head 130 due to the entry of bubbles or dust into ink. Further, since ink is passed through the inkjet head 130 in the process of ink circulation, a certain amount of ink increased in viscosity, which is adhered in the inkjet head 130, can be carried along the ink circulation route.

In addition, the inkjet printer 100 includes the controller 400 for controlling the processes of printing, ink circulation, and maintenance for the ink head unit 230. The controller 400 is composed of CPU, an image process unit, a memory, and the like.

The controller 400 includes a print controller 410, a print condition determiner 420, an ink circulation controller 430 and a maintenance controller 440. The print controller 410 is configured to calculate the amount of ink ejection per dot based on data of a print target, output the calculated result to the driver 132 of the inkjet head 130, and perform paper transfer processing.

The print condition determiner 420 is configured to set a printing condition based on printing information inputted from a control panel 500 provided on the inkjet printer 100 or printing information included in printing data sent from a connected PC and the like. The printing condition includes information of sheet size and color information of printing (i.e., color printing or black-and-white printing). The sheet size includes a standard size and a specified size by user setting. In either case, the length of a sheet in a main scanning direction (line direction) is a main factor of a criterion in maintenance processing as mentioned later. Also, when printing in black-and-white is set in the printing condition, it is performed only by use of black ink (real black). When printing in color is set in the printing condition, it is performed by use of ink with all of the colors of black, cyan magenta and yellow.

The ink circulation controller 430 controls drive of the pump 170 and switching of air inlet valves 221, 231 and a switching valve 280 (FIG. 5) so as to execute ink circulation processing to circulate ink in the ink circulation route. The ink circulation controller 430 is configured to execute ink circulation processing in the ink circulation routes for black, cyan, magenta and yellow when each printing. Note here that, when a printing is performed, ink circulation processing is executed for all of the nozzles of the inkjet heads 130K, 130C, 130M and 130Y including unused nozzles in the last printing. Such ink circulation processing can quickly recover difficulty in ejecting ink from the nozzles of the inkjet heads 130K, 130C, 130M and 130Y due to the entry of bubbles or dust into ink. In addition, this ink circulation processing can carry ink increased in viscosity along the ink circulation routes because ink is passed though inkjet heads 130. Thus, it is possible to prevent from performing excessive maintenance for the ink head unit 230.

Figure 5:
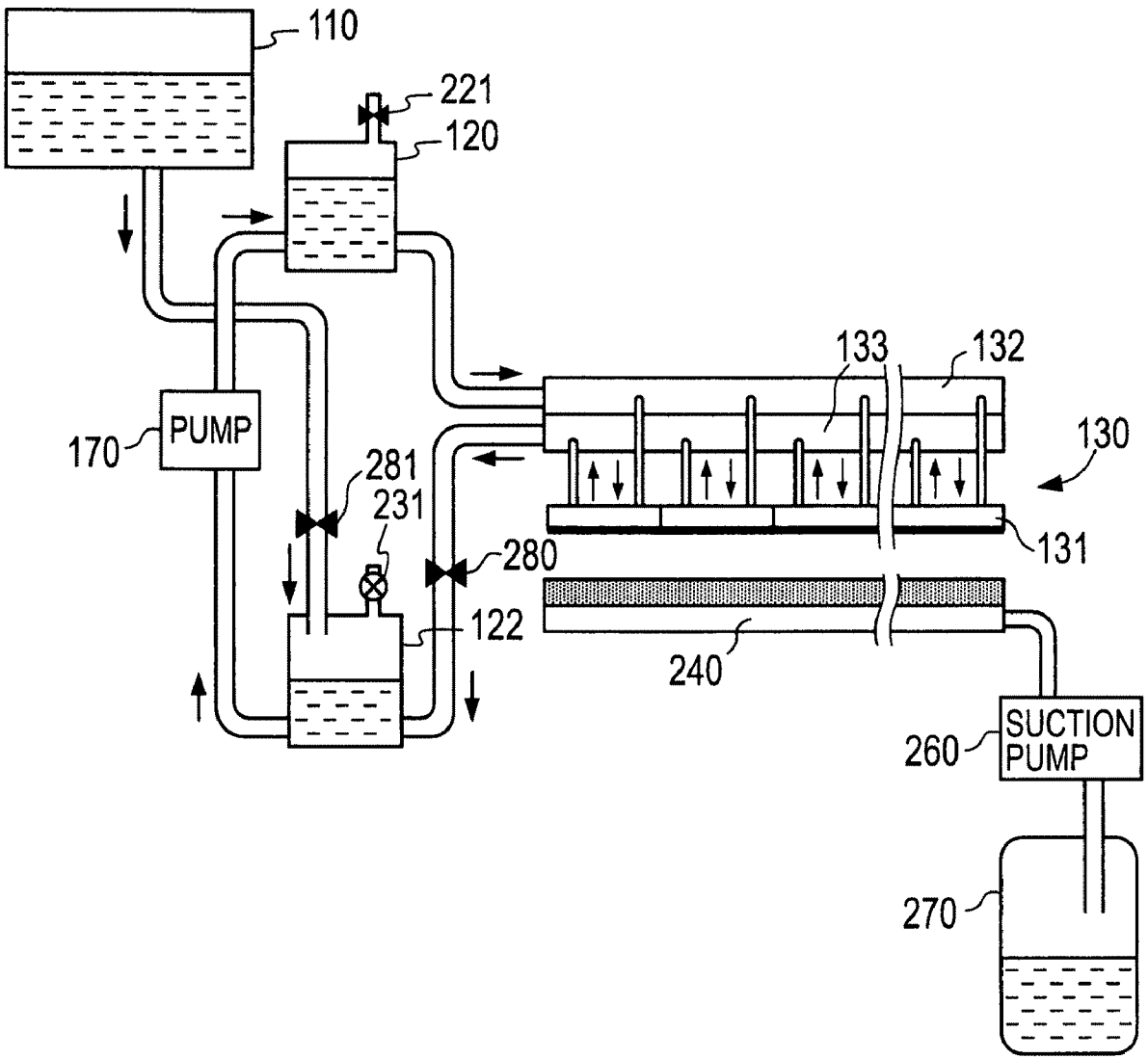
FIG. 5 is a block diagram showing one of the ink circulation routes and a constitution of a maintenance mechanism for an ink head unit on the route.

The maintenance controller 440 is configured to perform maintenance in some method including ink suction for the ink head unit 230 by use of a maintenance mechanism 240 (FIG. 5).

In the present embodiment, in order to prevent from performing excessive maintenance for the ink head unit 230, the maintenance controller 440 is configured to calculate a time interval between a present printing job and the last printing job, and compare printing conditions between the present printing job and the last printing job. Thus, the maintenance controller 440 includes a time-keeping function based on reference times T1 and T2. In addition, the maintenance controller 440 includes: a print condition recorder 441 that stores a printing condition in the last printing job, in particular, information of sheet size and color information of printing (i.e., color printing or black-and-white printing); and a print end time recorder 442 that stores the end time of the last printing job.

The reference time T1 represents a predetermined elapsed time from the last printing job. The reference time T1 is experimentally defined as a threshold time beyond which maintenance processing for the ink head unit 230 must be executed without any conditions. The reference time T1 is preliminarily determined according to an ink property, a shape of nozzles and the like. That is, if ink circulation processing is not executed after a predetermined elapsed time from the last printing job, maintenance processing must be executed for all of the inkjet heads 130K, 130C, 130M and 130Y without any conditions. Thus, the reference time T1 is determined as a criterion of maintenance processing in such a case.

The reference time T2 represents a predetermined elapsed time from the last printing job and is shorter than the reference time T1 (T2<T1). The reference time T2 is experimentally defined as a threshold time beyond which maintenance processing for the ink head unit 230 must be executed with a condition. The condition is that unused nozzles of the inkjet heads 130K, 130M, 130M and 130Y in the last printing are used in the present printing. The reference time T2 is preliminary determined according to an ink property, a shape of nozzles, an effect of ink circulation and the like. That is, even if the present printing job is performed before the reference elapsed time T1, when unused nozzles of the inkjet heads 130K, 130C, 130M and 130Y in the last printing is used in the present printing, the ink circulation processing when the last printing may not be sufficient as maintenance processing for the unused nozzles. Thus, the reference time T2 is determined as a criterion of maintenance processing in such a case.

Figure 4A:
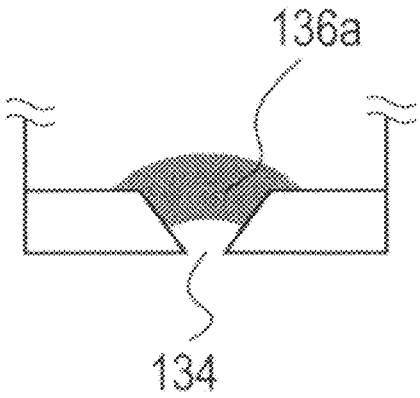
FIGS. 4A and 4B are views showing ink adhered around nozzles.
Figure 4B:
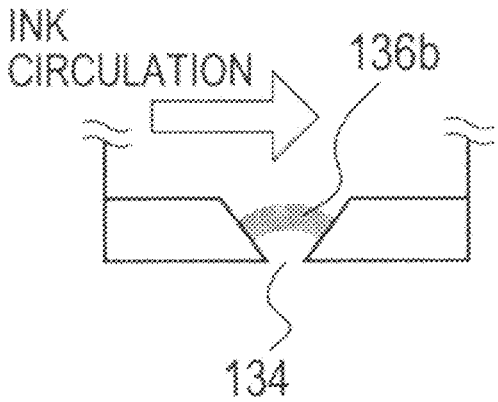

In other words, even if there are unused nozzles of the inkjet head 130 in the last printing, ink circulation processing was executed for the inkjet head 130K, 130C, 130M and 130Y when the last printing. Therefore, it is well assumed that a certain amount of ink with an increased viscosity adhered around the unused nozzles of the inkjet heads 130K, 130C, 130M and 130Y is removed if the elapsed time from the last printing job is within the reference time T2. FIGS. 4A and 4B are views showing such a situation. As shown in FIGS. 4A and 4B, ink 136*a* with an increased viscosity adhered around a nozzle 134 is cleared by ink circulation processing even if maintenance processing for the nozzle 134 are not performed in a method such as ink suction. Thus, the ink 136*a* results in ink 136*b* of which viscosity is lessened.

Even if the unused nozzles of the inkjet heads 130K, 130C, 130M and 130Y in the last printing are used in the present printing, maintenance processing is not necessary for the ink head unit 230 if the elapsed time from the previous printing job is within the reference time T2. Therefore, when it is performed in the present printing job to eject ink from the unused nozzles of the inkjet heads 130K, 130C, 130M and 130Y in the last printing, the present embodiment enables to reduce the number of maintenance processes in comparison with conventional methods.

The cases that the present printing job requests for ejecting ink from unused nozzles of the inkjet heads in the last printing includes several typical cases: (a) the present printing job requests for printing on a sheet with a larger size in the main scanning direction than one in the last printing; and (b) the present printing job requests for printing in color while the last printing job requested for printing in black-and-white. The maintenance controller 440 stores information of sheet size and color information of printing (i.e., color printing or black-and-white printing) on the print condition recorder 441 after each printing. However, when in the present invention we employ not a line-type inkjet printer but a serial-type inkjet printer, we can consider only the case (b) because we do not need to consider a sheet size in that case.

The ink circulation routes may be provided with thermometers in the inside of the inkjet heads 130K, 130C, 130M and 130Y or in the casing of the inkjet printer 100 to measure the temperature of ink so as to alter the reference times T1 and T2 according to the measured temperature. For instance, when ink of which viscosity increases as the temperature increases, is used, the higher the temperature is, the more the reference times T1 and T2 can be shortened.

FIG. 5 is a block diagram showing one of the ink circulation routes shown in FIG. 3 and the constitution of the maintenance mechanism 240 of the inkjet head 130. Note that FIG. 5 focuses on one of the ink colors (K, C, M and Y).

The inkjet head 130 includes a nozzle plate 131 provided with multiple nozzles to propel droplets of ink. The nozzle plate 131 is divided into a plurality of blocks. The inkjet head 130 includes a distributor 132 to supply ink to each block of the nozzle plate 131, and a collector 133 to collect ink that is not used in printing from each block of the nozzle plate 131.

As described above, ink supplied from the ink bottle 110 is temporally stored in the downstream tank 122 provided downstream of the inkjet head 130. The ink stored in the downstream tank 122 is transferred to the upstream tank 120 provided upstream of the inkjet head 130 by means of the pump 170, and the ink transferred to the upstream tank 120 is supplied to the inkjet head 130. The unused ink in printing in the inkjet head 130 is returned to the downstream tank 122 again. The consumed ink is replenished in the downstream tank 122 from the ink bottle 110 via a switching valve 281.

The inkjet head 130 is provided at a higher position than the downstream tank 122, and the upstream tank 120 is provided at a higher position than the inkjet head 130. Due to water head difference based on the positional relationship, supplying ink from the upstream tank 120 to the inkjet head 130 and returning ink from the inkjet head 130 to the downstream tank 122 are operated.

The upstream tank 120 and the downstream tank 122 are provided with the air inlet valves 221 and 231 respectively to switch an internal state of the tanks between a closed state and an open state.

The switching valve 280 is provided between the inkjet head 130 and the downstream tank 122. It is preferable that a filter to remove dust and bubbles from circulating ink is provided, for instance, between the pump 170 and the upstream tank 120. The filter can remove dust and bubbles in ink transferred from the upstream tank 120 to the inkjet head 130. Thus, we can prevent nozzle clogging that leads to difficulty in ejecting ink from the nozzles to some extent.

Figure 6:
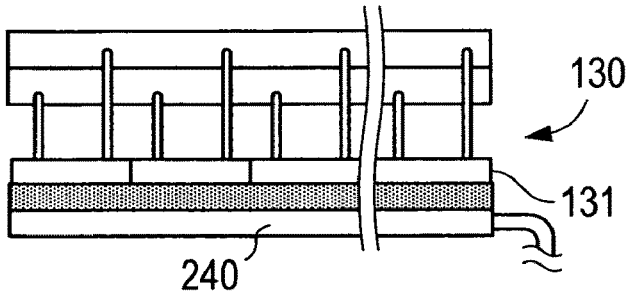
FIG. 6 is a view showing a connecting condition between a maintenance mechanism and an ink head unit.

Also, the inkjet printer 100 includes the maintenance mechanism 240 to execute maintenance processing for the inkjet head 130. The maintenance mechanism 240 has a configuration to cover the nozzle plate 131 of the inkjet head 130. Thus, when the printing mechanism is in a resting state, for instance, as shown in FIG. 6, the maintenance mechanism 240 serves as a cap in engagement with the in*jet head 130 so as to prevent ink from being deteriorated because of volatilization, evaporation, oxidation, and the like, of ink components. The maintenance mechanism 240 has a wiping function to remove ink from a surface of the nozzle plate 131 by use of rubber blades or rollers in the engagement state shown in FIG. 6, and a suctioning function to suction ink from the nozzle plate 131 by means of a suction pump 260. The suctioned ink is stored in a waste tank 270.

Note here that, in addition to the above-mentioned maintenance method that makes the maintenance mechanism 240 consume ink, a maintenance method called a "precursor operation" may be performed. The precursor operation serves to agitate the ink in the inkjet head 130 to recover an increased viscosity of ink to a normal state by delicately vibrating the piezo element in the inkjet head 130 with no ejecting ink from the nozzles. Although maintenance for the inkjet head 130 by precursor operation does not consume ink, the precursor operation requires a substantial time as a result Therefore, in this embodiment, we perform a maintenance control described later in order to reduce printing time by avoiding excessive precursor operation.

Figure 7:
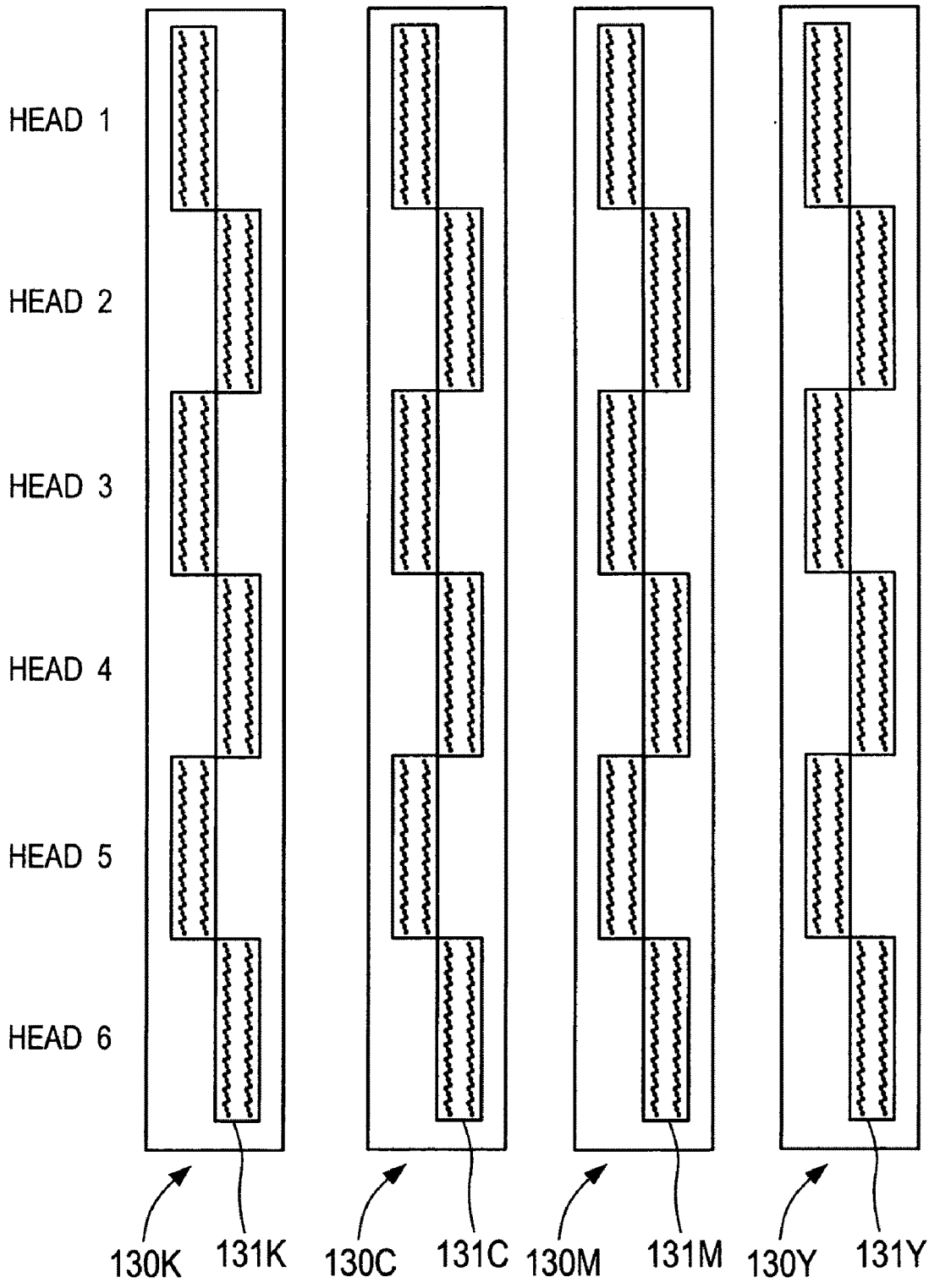
FIG. 7 is a view showing nozzles provided on nozzle plates from the viewpoint of the ink ejecting side of an ink head unit.

FIG. 7 is a view showing nozzle surfaces provided on the nozzle plates 131K, 131C, 131M and 131Y of the inkjet heads 130K, 131C, 131M and 131Y, from the viewpoint of an ink ejecting side of the inkjet heads. As shown in FIG. 7, the ink head unit 230 includes the inkjet head 130K for black ink, the inkjet head 130C for cyan ink, the inkjet head 130M for magenta ink and the inkjet head 130Y for yellow ink. The inkjet heads 130K, 131C, 131M and 131Y include nozzle plate 131K, 131C, 131M and 131Y, each of which is divided into six blocks, respectively. Each of the nozzle plates is provided with multiple nozzles from which ink is ejected. Note that the six blocks in each nozzle plate are referred to as heads 1 to 6, respectively.

Next, we will describe below a maintenance control of the inkjet printer 100 with reference to a flow chart shown in FIG. 8. We suppose here that the print condition recorder 441 in the maintenance controller 440 stores information of sheet size and color information of printing (i.e., color printing or black-and-white printing) in the last printing job, and that the print end time recorder 442 in the maintenance controller 440 stores information of the end time of the last printing job.

When receiving the present printing job via a connected PC or the control panel 500 (S101), the maintenance controller 440 determines whether the elapsed time from the last printing job to the present printing job is more than the reference time T1 with reference to the current time and the end time of the last printing job recorded in the print end time recorder 442 (S102).

If the elapsed time from the previous printing job is more than the reference time T1 (S102; Yes), then the maintenance mechanism 240 executes maintenance processing for the ink head unit 230(S103). This is because, as described above, the reference time T1 is determined as the threshold time after which maintenance processing for the ink head unit 230 must be executed because all of the inkjet heads 130K, 130C, 130M and 130Y has not been used for a long time and therefore ink circulation processing has not been executed too. Then, the present printing is performed after maintenance processing (S106).

If, on the contrary, the elapsed time from the last printing job is less than the reference time T1 (S102; No), then the maintenance controller 440 determines whether the present printing job requests for ejecting ink from unused nozzles of the inkjet heads in the last printing job (S104). This means that the maintenance controller 440 determines whether the present printing job requests for printing on an sheet larger than the last printing job in the main scanning direction, whether the present printing job requests for printing in color while the last printing job requested for printing in black-and-white, or whether the present printing job is an other case.

Thus, the maintenance controller 440 determines whether the present printing job requests for ejecting ink from the unused nozzles of the inkjet heads in the last printing job with reference to the printing condition of the last printing job (that is, the information of print size and the color information of printing) recorded in the print condition recorder 441 and the printing condition of the present printing job (that is, information of print size and color information of printing).

If the present printing job does not request for ejecting ink from the unused nozzles of the inkjet heads in the last printing (S104; No), the present printing is performed without maintenance processing for the ink head unit 230 because the present printing is performed within the reference time T1 from the last printing job (S106). Note here that in this case all of the nozzles of the inkjet heads ejecting ink in the present printing were ejected ink in the last printing.

If, on the contrary, the present printing job requests for ejecting ink from the unused nozzles of the inkjet heads in the last printing job (S104; Yes), then the maintenance controller 440 determines whether the elapsed time from the last printing job to the present printing job is more than the reference time T2 with reference to the current time and the end time of the last printing job recorded in the print end time recorder 442 (S105).

If the elapsed time from the last printing job to the present printing job is more than the reference time T2 (S105; Yes), maintenance processing for the ink head unit 230 is executed by the maintenance mechanism 240 (S103). This is because, as described above, when the unused nozzles of the inkjet heads in the last printing is used in present printing, ink circulation processing executed in the last printing may not be sufficient as maintenance for the unused nozzles even if the present printing has been performed before the reference time T1. Thus, the reference time T2 is determined as the criterion for such maintenance processing. Then, the present printing job is performed after maintenance processing for the ink head unit 230 (S106).

If, on the contrary, the elapsed time from the last printing job is less than the reference time T2 (S105; No), the present printing job is performed without maintenance processing for the ink head unit 230 (S106). This is because, as described above, maintenance processing for the ink head unit 230 is not necessary even if the present printing job requests for ejecting ink from the unused nozzles in the last printing because ink circulation processing in the past printing was executed for all of the inkjet heads when the last printing job and the elapsed time from the last printing job is less than the reference time T2. Therefore, we can avoid excessive maintenance processing for the ink head unit 230.

In any case, when the present printing job is finished, the end time of the present printing job is stored in the print end time recorder 442, the information of sheet size and the color information of printing (i.e., color printing or black-and-white printing) in the present printing job are stored in the print condition recorder 441 (S107), and all the present processes are completed.

Figure 8:
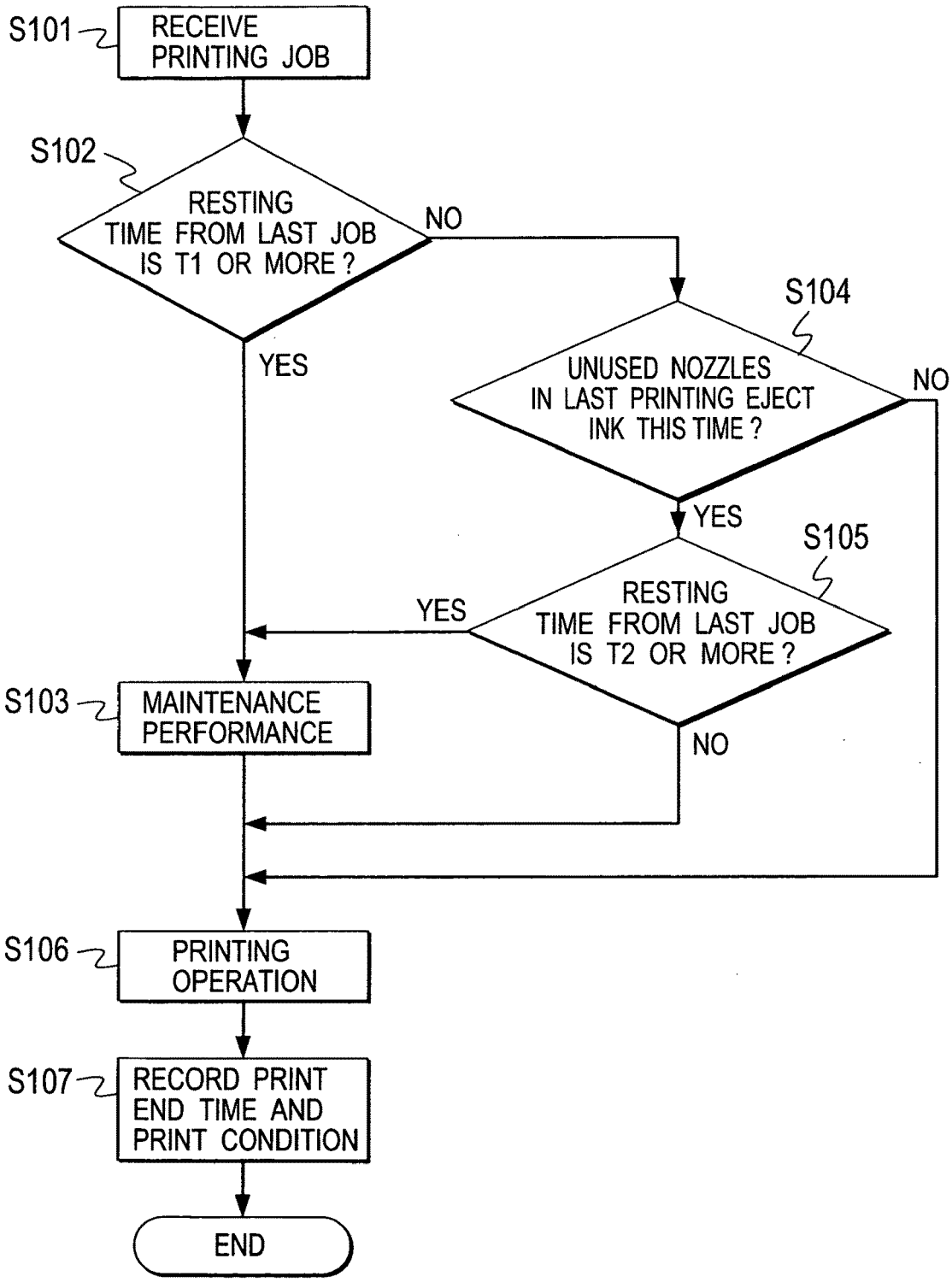
FIG. 8 is a flow chart showing a maintenance control according to an embodiment of the present invention.
Figure 9:
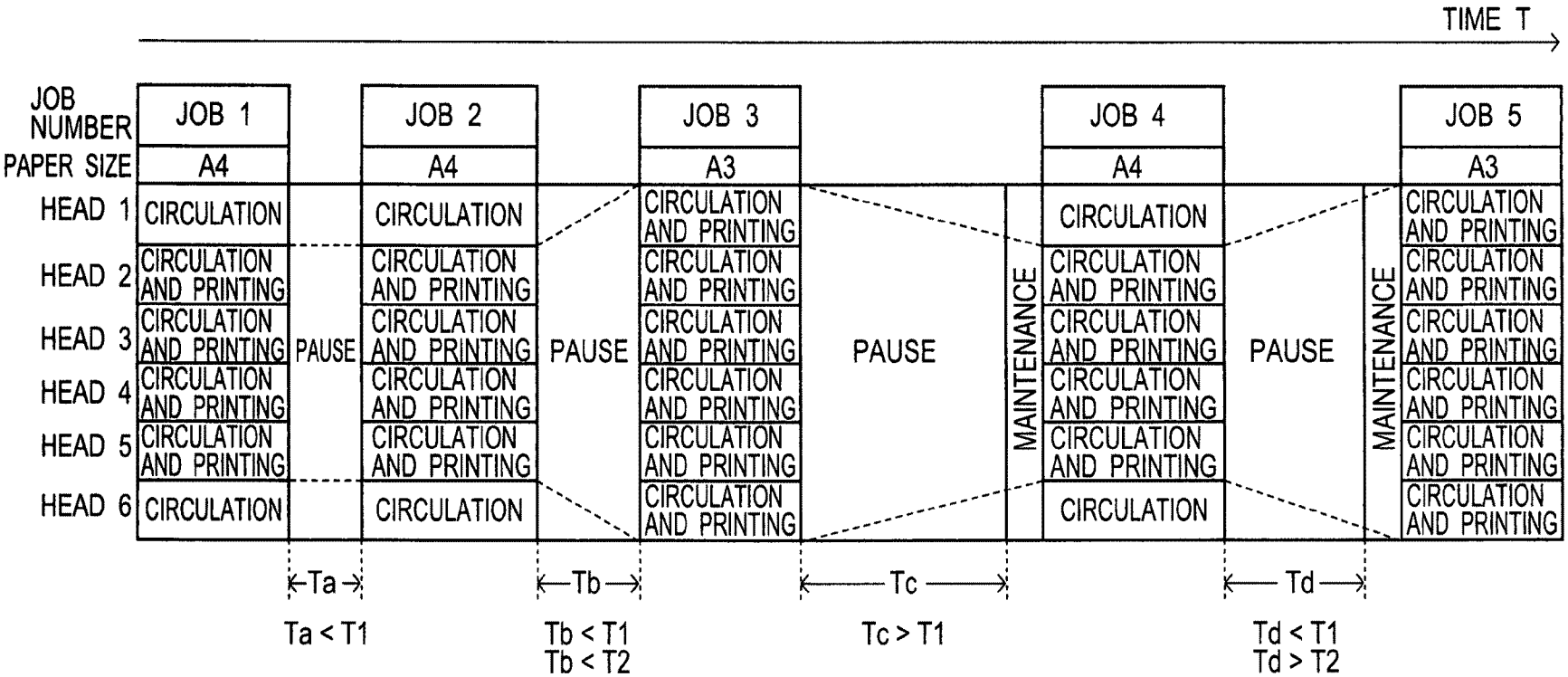
FIG. 9 is a view showing one example of printing processes based on the maintenance control shown in FIG. 8.

FIG. 9 is a view showing one example of printing processes based on the maintenance control shown in FIG. 8. This example includes five printing jobs 1 to 5. The jobs 1, 2 and 4 perform printing on A4 size sheets, and the jobs 3 and 5 perform printing on A3 size sheets. Note that all printing is performed in color for ease of explanation. Thus, whether a present printing job requests for ejecting ink from unused nozzles in the last printing job (S104) is determined by only the comparison of the sheet size in the present printing job to one in the previous printing job.

At the beginning, the job 1 is performed with printing on A4 size sheets. Thus, both of ink circulation processing and ink ejecting are executed in the heads 2 to 5 (FIG. 7), and only ink circulation processing is executed in the heads 1 and 6. After the job 1 is performed, when the job 2 to be performed with printing on A4 size sheets is accepted after a elapsed time Ta (Ta<T1), the job 2 is performed with printing and ink circulation processing without the maintenance processing for the ink head unit 230 (S106) because the elapsed time Ta from the job 1 is less than the reference time T1 (S102; No), and the job 2 does not requests for ejecting ink the unused nozzles in the job 1 (S104; No).

After the job 2 is performed, the job 3 to be performed with printing on A3 size sheets is accepted after an elapsed time Tb (Tb<T1, Tb<T2). Although the elapsed time Tb from the job 2 is less than the reference time T1 (S102; No) and the job 3 requests for ejecting ink from the unused nozzles in the job 2 (S104; Yes), the elapsed time Tb from the job 2 is less than the reference time T2 (S105; No). Therefore, both of printing and ink circulation processing in the job 3 are executed without maintenance processing for the ink head unit 230 (S106). Thus, it is possible to avoid excessive maintenance processing for the ink head unit 230.

After the job 3 is performed, the job 4 to be performed with printing on A4 size sheets is accepted after an elapsed time Tc (Tc>T1). Then the elapsed time Tc from the job 3 is more than the reference time T1 (S102; Yes). Therefore, maintenance processing for the ink head unit 230 is executed (S103) and then both of printing and the circulation processing in the job 4 are executed (S106).

After the job 4 is performed, the job 5 to be performed with printing on A3 size sheets is accepted after an elapsed time Td (Td<T1, Td>T2). Then the elapsed time from the job 4 is less than the reference time T1 (S102; No), the job 5 requests for ejecting ink from the unused nozzles in the job 5 (S104; Yes), and the elapsed time Td from the job 4 is more than the reference time T2 (S105; Yes). Therefore, maintenance processing for the ink lead unit 230 is executed (S103) and then both of printing and the circulation processing in the job 5 are executed (S106).

Note here that, while both of ink circulation processing and ink ejecting are executed for the heads 2 to 5 in the job 4, only ink circulation processing is executed for the heads 1 and 6 in the job 4. Therefore, it is well considered that the ink in the heads 1 and 6 is increased in viscosity in comparison with the ink in the heads 2 to 5. Thus, before the job 5 is performed, maintenance processing for the heads 1 and 6 may be enhanced in comparison with maintenance process for the heads 2 to 5.

According to the present embodiment as described above, it is possible to prevent from performing excessive maintenance for the ink head unit in the ink circulation type inkjet printer.

While preferred embodiments of the present invention have been described using specific terms, such description is for illustrative purposes, and it is to be understood that changes and variations may be made without departing from the spirit or scope of the following claims.

This application is based upon the Japanese Patent Application No. 2008-184159, filed on Jul. 15 2008, the entire content of which is incorporated by reference herein.

What is claimed is:

1. An ink circulation type inkjet printer comprising:

a plurality of inkjet heads, each of which provided with multiple nozzles to eject ink;

a plurality of ink circulation routes, which include the plurality of inkjet heads, respectively;

a maintenance mechanism that executes maintenance processing for the plurality of inkjet heads;

an ink circulation controller configured to circulate ink in all of the plurality of ink circulation routes for each printing job; and a maintenance controller configured to:

(1) allow the maintenance mechanism to execute the maintenance processing for the plurality of inkjet heads before a present printing job under three conditions that:

(c1) an elapsed time from a last printing job to the present printing job is less than a first reference time;

(c2) the present printing job requests for ejecting ink from unused nozzles of the multiple nozzles in the last printing job;

(c3) the elapsed time is more than a second reference time;

(2) allow the ink circulation type inkjet printer to perform the present printing job without the maintenance processing for the plurality of inkjet heads when the elapsed time is less than the predetermined second reference time.

2. The ink circulation type inkjet printer according to claim 1, wherein the first and second reference times are experimentally predetermined according to an ink property and a shape of nozzles, the first reference time is defined as a threshold time beyond which the maintenance processing for the plurality of inkjet heads must be performed without any conditions, and the second reference time is defined as a threshold time within which the maintenance processing for all of the plurality of inkjet heads does not need to be performed.

3. The ink circulation type inkjet printer according to claim 2, wherein the maintenance controller allows the maintenance mechanism to perform the maintenance processing for the plurality of inkjet heads before the present printing job when the elapsed time is more than the first reference time.

4. The ink circulation type inkjet printer according to claim 2, wherein the maintenance mechanism allows the ink circulation type inkjet printer to perform the present printing job without the maintenance processing for the plurality of inkjet heads by the maintenance mechanism when the elapsed time is less than the first reference time and the present printing job does not request for ejecting ink from the unused nozzles in the last printing job.

5. The ink circulation type inkjet printer according to claim 1, further comprising:

a plurality of thermometers, each of which measures a temperature of ink, and wherein the maintenance controller allows the first and second reference times to be altered according to measured values by the thermometers.

6. The ink circulation type inkjet printer according to claim 1, wherein the plurality of inkjet heads are line type inkjet heads.

7. The ink circulation type inkjet printer according to claim 1, wherein the maintenance controller stores an end time of present printing job and printing conditions of the present printing job after the present printing job.

8. The ink circulation type inkjet printer according to claim 1, wherein the maintenance processing for the plurality of inkjet heads by the maintenance mechanism is a process to consume ink.

* * * * *

UNITED STATES PATENT AND TRADEMARK OFFICE

CERTIFICATE OF CORRECTION

PATENT NO. : 8,128,190 B2
APPLICATION NO. : 12/458435
DATED : March 6, 2012
INVENTOR(S) : Nishimura et al.

It is certified that error appears in the above-identified patent and that said Letters Patent is hereby corrected as shown below:

Title Page delete "(73) Assignee: National University Corporation
Hokkaido University, Hokkaido (JP)"

so that correct assignee is identified as:

(73) Assignee: RISO KAGAKU CORPORATION, Toyko (JP)

Signed and Sealed this
Second Day of October, 2012

David J. Kappos

David J. Kappos
*Director of the United States Patent and Trademark Office*